US010265569B2

(12) United States Patent
Miller et al.

(10) Patent No.: US 10,265,569 B2
(45) Date of Patent: Apr. 23, 2019

(54) EXERCISE LIFTING BAR WITH TRANSLATING HAND GRIPS

(71) Applicant: Edge Prototype LLC, Hamilton, OH (US)

(72) Inventors: Brandon Wayne Miller, Liberty Township, OH (US); Donald Scott Yeager, Loveland, OH (US); Martin Carlos Todd, Somerville, OH (US)

(73) Assignee: Edge Prototype LLC, Hamilton, OH (US)

( * ) Notice: Subject to any disclaimer, the term of this patent is extended or adjusted under 35 U.S.C. 154(b) by 0 days.

(21) Appl. No.: 15/167,986

(22) Filed: May 27, 2016

(65) Prior Publication Data

US 2016/0339292 A1 Nov. 24, 2016

Related U.S. Application Data

(63) Continuation of application No. 14/720,788, filed on May 24, 2015, now Pat. No. 9,375,601.

(Continued)

(51) Int. Cl.
*A63B 21/00* (2006.01)
*A63B 21/072* (2006.01)

(Continued)

(52) U.S. Cl.
CPC ..... *A63B 21/4035* (2015.10); *A63B 21/072* (2013.01); *A63B 21/0724* (2013.01);

(Continued)

(58) Field of Classification Search
CPC ..... A63B 21/0004; A63B 21/00058; A63B 21/00061; A63B 21/00065; A63B 21/00069; A63B 21/00072; A63B 21/00076; A63B 21/02; A63B 21/022; A63B 21/023; A63B 21/025; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/072; A63B 21/0722; A63B 21/0724; A63B 21/0728; A63B 21/075; A63B 21/078; A63B 21/0783; A63B 21/08; A63B 21/15; A63B 21/159; A63B 21/4023; A63B 21/4033; A63B 21/4035; A63B 21/4039; A63B 21/4043; A63B 21/4045;

(Continued)

(56) References Cited

U.S. PATENT DOCUMENTS 1,779,594 A * 10/1930 Hall ..... A63B 21/0728 482/107
1,956,498 A 4/1934 Duke (Continued)

*Primary Examiner* — Gary D Urbiel Goldner
(74) *Attorney, Agent, or Firm* — Brian P. Overbeck

(57) ABSTRACT

Provided is an exercise lifting bar having at least two hand grips, an integral loading surface for holding optional plate weights coupled to each hand grip, the paired or coupled grips and loading surfaces thereby defining a member; the members further being substantially cylindrical, collinear, and operable to translate relative to one another. Also included is a translation limiter to limit the motion between the members. Methods of assembly of the exercise lifting bar are also provided.

11 Claims, 8 Drawing Sheets

Related U.S. Application Data

(60) Provisional application No. 62/006,859, filed on Jun. 2, 2014, provisional application No. 62/086,687, filed on Dec. 2, 2014.

(51) Int. Cl.
*A63B 21/078* (2006.01)
*A63B 71/00* (2006.01)

(52) U.S. Cl.
CPC ..... *A63B 21/0783* (2015.10); *A63B 21/4045* (2015.10); *A63B 2071/0072* (2013.01)

(58) Field of Classification Search
CPC . A63B 23/12; A63B 23/1209; A63B 23/1236; A63B 23/1245; A63B 23/1254; A63B 71/0054; A63B 2071/0063; A63B 2071/0072; A63B 2071/0081; A63B 2071/009; A63B 2208/0242; A63B 2208/0252; A63B 2210/50; A63B 2225/09; A63B 2225/093; A63B 2244/09
See application file for complete search history.

(56) References Cited

U.S. PATENT DOCUMENTS 2,470,816 A * 5/1949 Harvey ..... A63B 15/00 482/108
2,528,213 A * 10/1950 Dantolan ..... A63B 21/072 482/131
3,118,668 A 1/1964 Callahan
3,231,270 A * 1/1966 Winer ..... A63B 21/0602 482/106
3,343,837 A 9/1967 Grzybowski
3,384,370 A 5/1968 Bailey et al.
3,756,597 A 9/1973 Monti
3,761,083 A 9/1973 Buchner
3,904,198 A 9/1975 Jones
3,938,803 A 2/1976 Wilmoth
3,971,255 A * 7/1976 Varney ..... A61B 5/224 482/114
4,461,473 A 7/1984 Cole
4,471,956 A 9/1984 Marlo
4,585,229 A 4/1986 Brasher
4,618,142 A * 10/1986 Joseph, Jr. ..... A63B 5/20 482/106
4,623,146 A 11/1986 Jackson
4,690,400 A 9/1987 Metz
4,695,049 A 9/1987 Ciemiega
4,743,018 A * 5/1988 Eckler ..... A63B 21/0724 482/106
4,749,188 A * 6/1988 Montgomery ..... A63B 21/0602 482/106
4,775,149 A 10/1988 Wilson
4,943,052 A 7/1990 Powers
4,978,122 A 12/1990 Dibowski
5,024,434 A * 6/1991 Smith ..... A63B 21/0724 482/106
5,152,731 A 10/1992 Troutman
5,211,616 A 5/1993 Riley, Jr.
5,257,964 A 11/1993 Petters
5,300,002 A * 4/1994 Freye ..... A63B 23/12 482/114
5,334,118 A * 8/1994 Dantolan ..... A63B 15/005 482/109
5,496,244 A 3/1996 Caruthers
5,509,879 A * 4/1996 Lanzagorta ..... A63B 21/015 482/115
5,536,227 A * 7/1996 Polchek ..... A63B 21/0728 482/106
5,620,402 A 4/1997 Simonson
5,686,176 A 11/1997 Adam et al.
5,697,873 A 12/1997 Van Straaten
5,820,531 A * 10/1998 Choi ..... A63B 21/0603 482/110
5,836,858 A * 11/1998 Sharff ..... A63B 21/0724 482/104
5,891,004 A 6/1999 Berry
6,022,300 A 2/2000 Hightower
6,186,930 B1 * 2/2001 Ignaczak ..... A63B 23/12 482/141
6,196,953 B1 * 3/2001 Buchanan ..... A63B 21/072 482/114
6,976,942 B2 12/2005 Kennedy
7,056,268 B2 6/2006 Emick
7,086,999 B2 8/2006 Jeneve et al.
7,108,643 B2 9/2006 Wilson et al.
7,393,309 B2 7/2008 Webber
7,794,377 B2 9/2010 Amzallag et al.
7,862,486 B1 1/2011 Watson
7,892,158 B2 2/2011 Varga
7,909,743 B1 3/2011 Webber
8,047,973 B2 11/2011 Berenshteyn
8,328,698 B1 12/2012 Webber et al.
9,005,087 B1 * 4/2015 Betoney, Jr. ..... A63B 21/06 482/104
2002/0107150 A1 8/2002 Mikami et al.
2003/0096680 A1 * 5/2003 Nethery ..... A63B 21/0004 482/92
2004/0132590 A1 7/2004 Papas
2006/0276314 A1 * 12/2006 Wilson ..... A63B 21/015 482/106
2008/0081747 A1 * 4/2008 Mok ..... A63B 21/0004 482/121
2008/0176723 A1 * 7/2008 Johnson ..... A63B 21/0724 482/106
2008/0261788 A1 10/2008 Blount
2009/0197742 A1 * 8/2009 Hartman ..... A63B 21/026 482/50
2010/0075815 A1 * 3/2010 Deppen ..... A63B 21/0728 482/93
2010/0152002 A1 * 6/2010 Knight ..... A63B 21/0552 482/93
2010/0190618 A1 * 7/2010 Chen ..... A63B 21/0728 482/108
2010/0197470 A1 * 8/2010 Hartman ..... A63B 23/16 482/139
2010/0222186 A1 * 9/2010 Grand ..... A63B 21/0602 482/107
2010/0227747 A1 9/2010 Cook
2011/0177922 A1 * 7/2011 Selinger ..... A63B 21/0724 482/107
2012/0094812 A1 4/2012 Smiley
2013/0035218 A1 2/2013 Wierszewski
2014/0045660 A1 2/2014 Murray et al.
2014/0221173 A1 * 8/2014 Crabtree ..... A63B 21/0724 482/106
2014/0323275 A1 * 10/2014 Moses, II ..... A63B 21/1627 482/40

* cited by examiner

EXERCISE LIFTING BAR WITH TRANSLATING HAND GRIPS

PRIORITY INFORMATION

The present application claims priority to and is a U.S. Continuation Patent Application of U.S. Non-Provisional patent application Ser. No. 14/720,788 titled "Exercise lifting bar with translating hand grips" of Brandon Wayne Miller, et. al., filed on May 24, 2015, now U.S. Pat. No. 9,375,601; and claims priority to U.S. Provisional Patent Application Ser. No. 62/006,859 titled "Exercise lifting bar with translating hand grips" of Brandon Wayne Miller, et. al., filed on Jun. 2, 2014; and claims priority to U.S. Provisional Patent Application Ser. No. 62/086,687 titled "Exercise lifting bar with translating hand grips" of Brandon Wayne Miller, et. al., filed on Dec. 2, 2014; and claims priority to U.S. Design patent application Ser. No. 29/511,955, titled "Exercise lifting bar" of Brandon Wayne Miller, et. al., filed on Dec. 15, 2014, the disclosures of which are all incorporated by reference herein.

FIELD OF THE INVENTION

The present invention relates to fitness equipment, more particularly, to a lifting bar adapted to optionally carry weight.

GOVERNMENT RIGHTS IN PATENT

No U.S. Government agency has a property interest in the application.

BACKGROUND

Free weight lifting is and will remain an important part of the fitness industry for a very long time to come. Those who use free weights to exercise benefit from the efficiency, low-complexity, and portability offered by the ability to move equipment, such as dumbbells and barbells and sometimes accompanying plate weights to any type of bench (flat, incline, or decline), an outdoor location, or other location of their choice. This is in comparison to exercising with a dedicated nautilus or single motion or single-purpose cable resistance machine which is often very large and generally limited to a given location.

One popular free weight exercise is the dumbbell press. The dumbbell press, when executed on a flat bench, is performed by a weight lifter grasping a dumbbell in each hand, then, while lying with the lifter's back flat on a bench with arms bent, spread away from the torso, and generally with the upper arm parallel to the top of the shoulders, pressing the hands up and away from the bench while urging the hands together over the chest. This dumbbell press is especially popular as it exercises multiple chest or pectoral muscles in a single motion, and can be replicated on an incline or decline bench, offering varied angles of hand press relative to the lifter's torso position. However, as a weight lifter's strength increases, heavier and heavier dumbbells are needed to continue to build muscle and improve strength, often requiring the use of single dumbbell weights exceeding 150 lbs. These heavier dumbbells present a significant safety risk to the lifters, as the lifters often have to pull the dumbbells off standing racks, carry them to the bench, and curl or lift them into position while seated on the bench, all resulting in unwarranted stress on back, shoulder, elbow, and wrist joints and raising risk for injury to the lifter and those nearby. This risk erodes the portability desired by those who exercise with free weights.

A second popular, and arguably the most popular, free weight exercise is the barbell press. One benefit of the barbell press, in contrast to handling increasingly heavy dumbbells and the related aforementioned risks, is that as a weight lifter sees increases in strength, the lifter need only add a weight plate, often weighing 45 pounds, to either end of the barbell that is typically positioned on a rack integrated with the bench. The barbell press, like the dumbbell press, can be executed on while lying on a flat bench with arms positioned like those for a dumbbell press and targets the chest or pectoral muscles. However, unlike the dumbbell press, the lifter uses a single barbell held with both hands fixed in position relative to one another, and when the lifter presses the hands up and away from the bench there is no urging of the hands together over the chest. This hand restriction reduces the efficiency of the exercise, as only the outer pectoral muscles are utilized, and also places undue strain on the shoulder joints not present with the dumbbell press. This restriction erodes the efficiency desired by those who exercise with free weights.

Accordingly, there exists an opportunity to improve the safety and efficiency of free weight exercises that target the pectoral muscles while maintaining the portability and low-complexity free weight lifters desire.

SUMMARY

The problems of efficiency and safety when exercising the pectoral muscles are solved in at least one aspect while maintaining low-complexity and portability by a free weight barbell, or exercise lifting bar, with translating hand grips, with the grips having an integral weight application loading surface that moves with the grip.

One exemplary embodiment of the exercise lifting bar comprises at least two hand grips, an integral loading surface coupled to each hand grip, each couple thereby defining a member, wherein the members are substantially cylindrical, collinear, and translate relative to one another, and a translation limiter.

Another exemplary embodiment of the exercise lifting bar includes hand grips having a perimeter from about 3.9 inches to about 5.2 inches.

In another exemplary embodiment of the exercise lifting bar, at least one of the members also has any single or combination of a counterweight, a spotter zone, and a damper.

In yet another exemplary embodiment, the members translate to an extended position, and at this extended position, the unbalance at the hand grips is a predetermined amount.

In another exemplary embodiment, the exercise lifting bar has a free standing first member having an elongated member and a second member. In this exemplary embodiment the first, second, and elongated members are collinear and substantially cylindrical, with the second member being slidably mounted to translate on the elongated member. Also in this exemplary embodiment, the first member has a first hand grip and a first integral loading surface and the second member has a second hand grip and a second integral loading surface. With the second member translating on the elongated member from an extended position to a compressed position, and whereby imbalance at the first and second hand grips decreases from the extended position to the compressed position.

In another exemplary embodiment the exercise lifting bar, the elongated member from the paragraph above has a translation limiter and any single or combination of one or more counterweight, a spotter zone, a bearing and a damper. Exemplary embodiments of bearings may be selected from a group consisting of plain bearings, rolling element bearings, and bushings. Furthermore, exemplary embodiments may include bushings selected from the group consisting of steel-backed PTFE bi-material bushings, unreinforced PTFE composite bushings, and reinforced PTFE composite bushings.

In yet another exemplary embodiment, the exercise lifting may have a lubricant selected from the group consisting of hydrocarbons, lithium greases, graphite-based greases, dry film lubricants, and PTFE.

In another exemplary embodiment, the exercise lifting bar has a stroke is defined as the distance along the elongate axis of the elongated member that the second member translates from the extended position to the compressed position, wherein the stroke is about 8 inches to about 36 inches. In another exemplary embodiment, the stroke is about 12 inches to about 30 inches.

In yet another exemplary embodiment of the exercise lifting bar at least one end of the elongated member remains inside the second member while translating to the extended position.

In another exemplary embodiment, the exercise bar has an instantaneous center of motion between the first and second members, wherein the length along the elongate axis of the elongated member measured from the end of the first integral loading surface closest to the instantaneous center of motion to the end of the second integral loading surface closest to the instantaneous center of motion at the extended position is greater than about 40 inches.

In another exemplary embodiment, the exercise lifting bar weighs about 10 pounds to about 75 pounds.

In another exemplary embodiment, the exercise lifting bar has an elongated member being substantially a ferrous material.

In yet another exemplary embodiment of the exercise lifting bar the friction, as defined below, is between about 0.01 to about 1.00.

In another exemplary embodiment, the exercise lifting bar has a first member and a second member, the first member having an elongated member, wherein the first, second, and elongated members are collinear and substantially cylindrical, where the second member is slidably mounted to translate on the elongated member, the first member having a first attachment feature configured to connect to a cable and the second member having a second attachment feature configured to connect to a cable, and a translation limiter.

In another exemplary embodiment of the exercise lifting bar, the first member has a first hand grip and a first integral loading surface and the second member has a second hand grip and a second integral loading surface.

In another exemplary embodiment of the exercise lifting bar, a first cable is connected to the first attachment feature and a second cable is attached to the second attachment feature, and the first cable and second cable are substantially equal length.

BRIEF DESCRIPTION OF THE DRAWINGS

The description herein makes reference to the accompanying drawings wherein like reference numerals refer to like parts through several views wherein.

DETAILED DESCRIPTION

The category of free weight exercises generally refers to a person using a free standing piece of equipment, device, or member. Hereafter, free standing is understood to mean not supported by another structure, excluding the person or persons performing the exercise. Dumbbell and barbell presses are popular free weight exercises that target the pectoral muscles. The problems of efficiency and safety when executing these presses are solved in at least one aspect by a free weight barbell 10 with translating hand grips 21 and 31, with the grips having integral loading surfaces 22 and 32 that move with the grip. The translating grips 21 and 31 allows for a full hand motion, similar to the dumbbell press, optimizing the chest workout, while the integral loading surfaces 22 and 32 allow for safely adding optional weight plates 50 in on a surface that remains proximal to the hand grips 21 and 31 throughout the exercise, similar to the barbell press. However, when compared to a barbell press, such translation raises additional problems, including, for example, supporting a moving load while assuring a comfortable grip size for the hand, barbell imbalance, and hand motion synchronization. Each of these problems will be addressed while describing exemplary embodiments of the invention.

Figure 1:
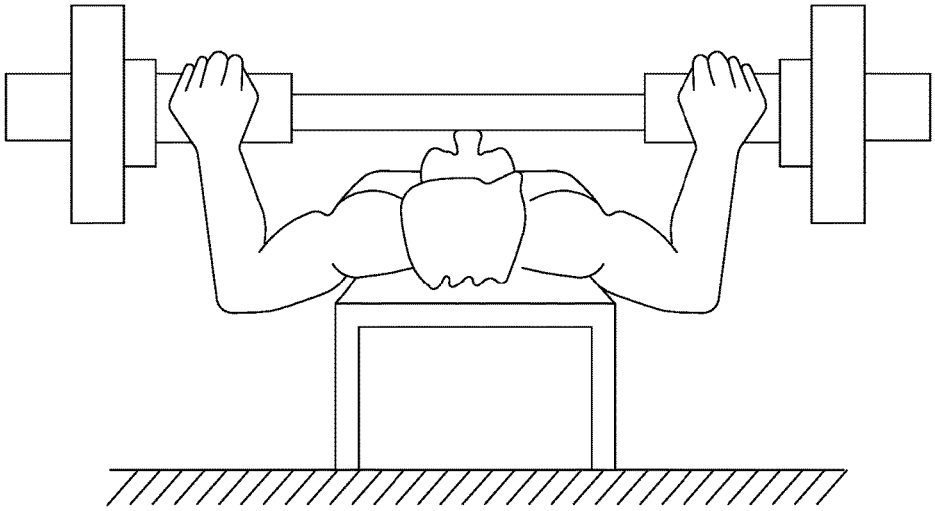
FIGS. 1 and 2 are a perspective views of a lifter's hand positions that may occur during use of a first exemplary embodiment, with 1 describing the full extension in the 'hands out' position and 2 describing the full compression in the 'hands in' position.
Figure 2:
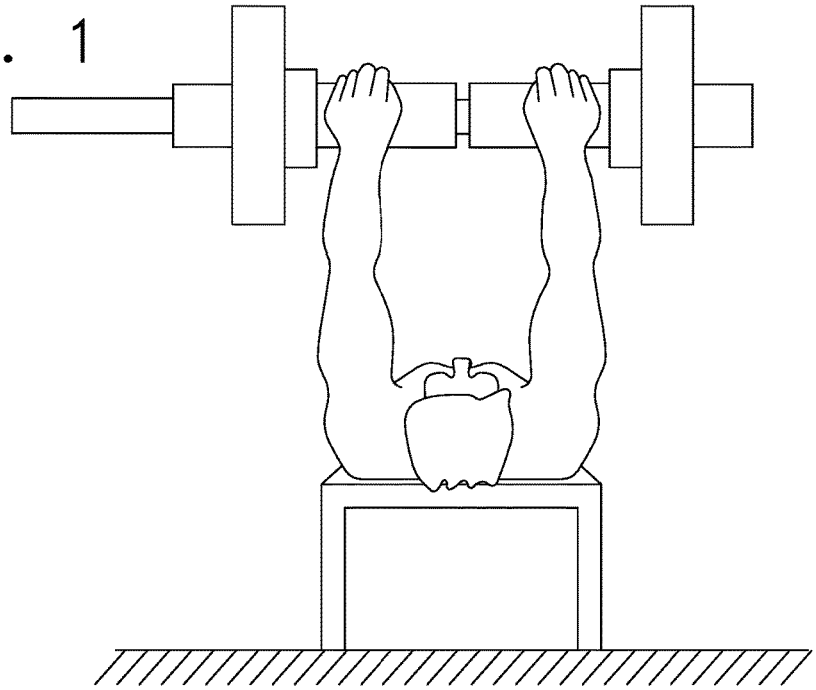

To baseline this translating motion and to assist in understanding the included figures, FIG. 1 and FIG. 2 detail a lifter performing a press exercise with an exemplary embodiment of the barbell 10, with FIG. 1 showing the exercise in the 'hands out' position and FIG. 2 showing the exercise in the 'hands in' position. Please note also that like figures with descriptors 'a' or 'b' or sequential numbers (e.g. 3 and 4) may reference these same positions, and that the 'hands out' position is alternatively referred to as the extended position and the 'hands in' position is alternatively referred to as the compressed position. Referring now to an exemplary embodiment of the invention, in section view, in FIG. 3 and FIG. 4, this translation can be achieved with a barbell 10 having two members that move relative to one another along the same longitudinal axis 100 and generally about an orthogonal axis 200 that represents the instantaneous center of motion between hands throughout the translation. The first member 20 has a hand grip 21, where the lifter grasps member 20, and an integral loading surface 22, where plate weights 50 may optionally be placed. In this exemplary embodiment, an elongated member 23, which may optionally be a tube of constant section, is fixed to first member 20. The second member 30 has a hand grip 31, integral loading surface 32 (again where plate weights 50 may optionally be placed), and a bearing surface 33. When a weight lifter presses the barbell 10 and urges the two members together, the second member 30 translates on the elongated member 23 via sliding contact with the bearing surface 33 toward the first member 20. The elongated member 23 is the main load carrying member of barbell 10 and acts to transfer the force applied by the lifter at the grip 21, and at grip 31, through bearing surface 33 to react the mass of barbell 10 and any optionally applied plate weights 50. In this exemplary embodiment, the cross-sections of the members, grips, and surface are circular. The diameter of the elongated member 23 is an important parameter in both the operation and comfort of grips 21 and 31 and in the cost of manufacturing barbell 10. The first and second members, 20 and 30 respectively, may be made from steel or another suitable material considering factors such as strength, density, and cost for manufacturing barbells for the exercise equipment industry. The material of elongated member 23 may be selected from the group consisting of ferrous, aluminum, and titanium metals including alloys of these metals. Surface treatment of the members, including elongated member 23, such as surface hardening, may provide resistance to handling damage and a smooth translating surface, exemplary ranges of surface hardness may be from about 70 Rockwell hardness on a C-scale (HRC) to about 30 Rockwell hardness on a C-scale (HRC). Another exemplary embodiment of ranges of surface hardness may be from about 65 Rockwell hardness on a C-scale (HRC) to about 55 Rockwell hardness on a C-scale (HRC). Other surface treatments of the members may provide a protective finish or coating to protect the surfaces of the barbell from oxidation, wear, or any flaws that could occur during manufacture, transport, or normal operation. An exemplary embodiment of the members may include surface treatment deposited by methods selected from the group consisting of electroplating and electroless plating. Exemplary materials used in these plating methods include, for example, Zinc, Chrome, Tin, Cadmium, Nickel, and like alloys. Alternate surface treatments, for ferrous and zinc materials, may include conversion coating, such as black oxide or blackening. In addition to the aforementioned surface treatments, powder coating may be applied to members 20, 23, and 30.

Bearing surfaces 33 may be defined by bearings 46. Exemplary embodiments of the barbell 10 may include bearings 46 selected from the group consisting of plain bearings, rolling element bearings, bushings, and the like. Other exemplary embodiments of barbell 10 may include bearings 46 selected from the group consisting of metal, bi-material, composite bushings, and the like. Still other exemplary embodiments of barbell 10 may include bearings 46 selected from the group consisting of bi-material bushings made from steel-backed Polytetrafluoroethylene (PTFE), unreinforced composite bushings including PTFE, reinforced composite bushings including PTFE, and the like.

Another aspect to consider is managing the friction at bearing surfaces 33. As defined herein, friction is the ratio of load acting substantially parallel to axis 100 at bearing surface 33 over the load normal at bearing surface 33. An exemplary range of friction for this application is from about 0.01 to about 1. Another exemplary range of friction is from about 0.005 to about 0.5. The optional use of lubricants such as, but not limited to, hydrocarbons, lithium grease, graphite based grease, dry film lubricants, and the like may be beneficial. Yet another option for managing friction may include the use of anti-friction coatings along the exterior surface of elongated member 23 such as PTFE or the like, which may be sprayed, painted, dipped or otherwise applied and cured at a suitable thickness. Optional exemplary thicknesses for anti-friction coating may range from about 0.0001" to about 0.050".

Figure 3:
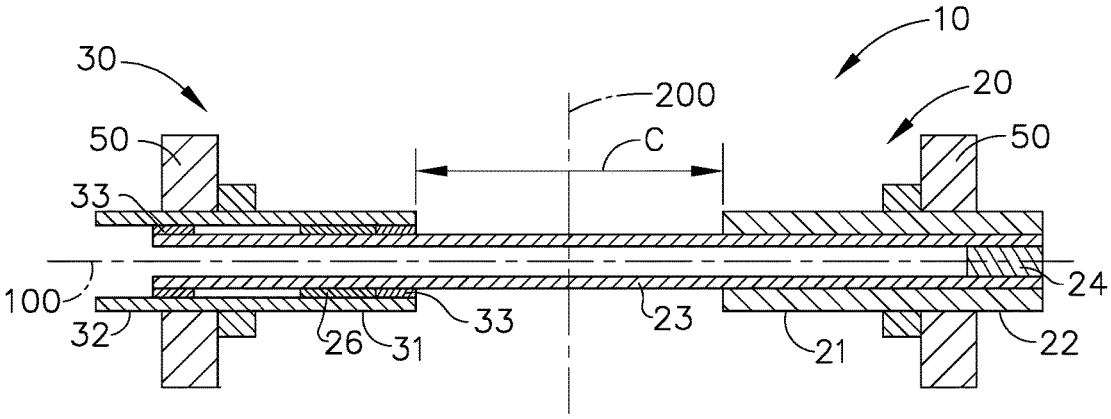
FIGS. 3 and 4 are cutaway views of a first exemplary embodiment, with 3 describing the full extension in the 'hands out' position and 4 describing the full compression or in the 'hands in' position.

Exemplary embodiments of barbell 10 would have length along axis 100 of the barbell 10 at the 'hands-out' position of about 60 inches to about 96 inches, or about 68 inches to about 86 inches. An alternate exemplary embodiment of barbell 10 may have a length of about 30 inches to about 60 inches. Exemplary embodiments of barbell 10 have a length along axis 100 of the integral loading surfaces 22 and 32 from about 3 inches to about 16 inches. Additionally, the diameter loading surfaces 22 and 32 in exemplary embodiments can be from about 1 inch to about 2 inches. Two distances, one described in FIG. 3, the other in FIG. 4, assist in describing the stroke, S of the translation. FIG. 3 describes C, the distance between first member 20 and second member 30 along axis 100 in the 'hands out' position, and D, a similar distance in the 'hands in' position in FIG. 4. The translation or stroke is then defined as S, where S is the difference between C and D. The stroke of the exercise is important to gain a full range of hand motion and thereby an optimal chest workout. Another key is the feel the lifter has with the barbell 10.

As a lifter grasps grips 21 and 31 to perform a press, the comfort level that the lifter's hand has is important. If the circumference of the grip is too large, the lifter's fingers and palms will wrap only around a portion of the grips, and during the press will result in an awkward feel and place undue strain on the lifter's wrist when attempting to shift the bar into a position that is aligned in the plane of the press motion. Exemplary ranges of grip circumference from about 2.3 inches to about 6.3 inches or from about 3.9 inches to about 5.2 inches provide comfortable grips. The cross-section of the hand grips 21 and 31 may be optionally non-circular. These exemplary ranges are applicable for perimeter lengths of any alternate cross-sectional shapes. Additionally, for these exemplary comfortable grips, because the second member 30 and hand grip 31 translate on the elongated member 23, the diameter of the elongated member 23 also must be closely managed.

As a lifter exercises with free weights, the force opposing the motion of the lifter's hands is generally generated by gravity. Imbalance would then be the variation in this opposition force at the lifter's hands caused by the distribution of mass of the equipment the lifter is using. Turning again to FIGS. 3 and 4, where FIG. 3 shows an exemplary embodiment of barbell 10 in a 'hands out' position where a lifter would start the press motion and FIG. 4 shows a 'hands in' position where the hands are urged inward, mimicking the completed state of the dumbbell press motion. In the 'hands in' position, a portion of the elongated member 23 extends past the outermost edge of bearing surface 33, (shown inside a dashed box), and protrudes through member 30. This extended portion presents imbalance at grips 21 and 31, and if not mitigated, requires the lifter to compensate with additional force at grip 31 to overcome the imbalance and at the extreme may cause the lifter to lose control of barbell 10, allowing an applied plate weight 50 to slide off and possibly forcing the lifter to fall off of a bench or become unseated.

A potential way to eliminate the imbalance would be to maintain a constant linear weight of the barbell 10 throughout the motion. However, this would require an overlap between the members of the barbell to maintain balance about the instantaneous center of motion between hands, reference axis 200. This overlap about the center of motion restricts the stroke and presents interference at the area that the lifter grasps the barbell 10 when the members meet during the compression of the stroke. This may be avoided if the area that the lifter grasps the barbell of one member passes under the same area of the other member. For example, this maintenance, at the 'hands in' position, would require that a portion of the second member 30 pass under the grip 21 of the first member 20 to offset the mass of the portion of the elongated member 23 that extends past the outermost end of member 30. This raises a number of concerns. First, to allow this passage, the circumference or perimeter length of grip 21 would increase significantly pushing it outside of a comfortable range, and as discussed above, would degrade the comfort and feel that the lifter has with grip while executing the press. Second, this overlap presents an unavoidable pinch-point between members that would be a potential hazard to the hands of the lifter or a spotter assisting with the exercise. Third, the translation length or stroke of the press would be limited as a portion of the second member 30 that passes under the grip would need to carry a supporting element, and whose active stroke would be less than that afforded by member 20 due to relatively longer length of elongated member 23. Fourth, if an attempt to hold grip size at a comfortable level is made, the elongated member 23 would necessarily be reduced in circumferential length and thereby weakened to a point that its deflection under typical maximum press loads would be prohibitive at the bearing surfaces. Finally, although the linear weight may remain constant, the sectional properties of the members, for example the sectional moment of inertia, would be different, and would result in asymmetric deflection on the members during use, causing an unnatural lifting experience when compared to the even deflection across a traditional static barbell.

Another way to eliminate the imbalance would be to synchronize the grips such that they remain equidistant from the center of a barbell throughout the stroke. This synchronization could be accomplished by allowing the grips each to separately slide on a surface of the barbell while using a system of cabling or gearing to maintain this equidistant relationship. However, such a system would either reside inside the surface of the barbell that the grips slide on, where space is very limited, or external to the surface of the barbell that the grips slide on, forcing the circumference or perimeter length of grip 21 to increase significantly, pushing it outside of a comfortable range, and again as discussed above, would degrade the grip comfort and feel that the lifter experiences while executing the press.

Figure 4:
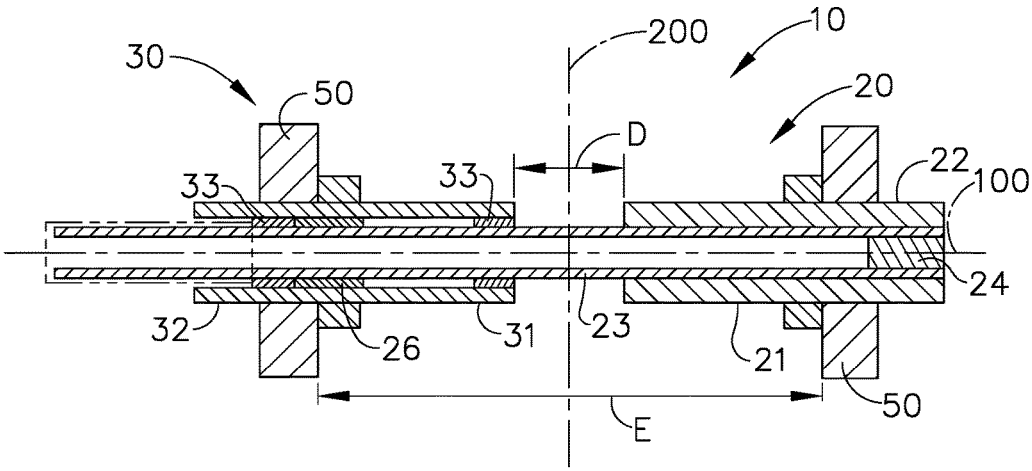

In contrast to both suggestions, as the exemplary embodiment depicted in FIGS. 3 and 4 show, by fixing elongated member 23 on first member 20, and thereby fixing the distance between handgrip 21 and the distributed mass of elongated member 23, combined with using a counterweight 24, the imbalance posed by the portion of elongated member 23 that extends past the outermost end of member 30 can be partially offset for at least a portion of the stroke. For example, counterweight 24, when placed near the outermost end of first member 20 can balance the bar at the 'hands in' position where the lifter is less able to counter the imbalance due to the close proximity of the grips, but maintains a purposeful slight imbalance at the 'hands out' position where the lifter can take advantage of the wide stance of handgrips and is better able to maintain control of the barbell. Although this example describes the 'hands-in' position as the balance position, any position throughout the stroke may be the balance position, and may be adjusted by varying the overhung portion of the elongated member 23, the mass of the counterweight 24, or both. Counterweight 24 can be of similar material as the members or optionally of a higher density to be efficiently combined with member 20 to offset the inertia of extended portion of elongated member 23. One of the results of this exemplary arrangement is that as the hand grips 21 and 31 move toward each other, the imbalance of the barbell 10 decreases. As indicated, the lifter benefits because as the hands move toward each other the length between the applied hand forces decreases, diminishing the ability for the lifter to counter any imbalance. The opposite is also the case, as the hands move away from each other the lifter has a relatively larger distance between applied forces allowing increased capability to counter any imbalance. This increases the safety and comfort that the lifter experiences with the exercise. Other features of barbell 10 also assist to reduce the imbalance a lifter sees while executing a press. For this exemplary and non-limiting embodiment, bearing surface 33 is located near the innermost portion of the integral loading surface 32, such that it remains under the optionally placed weight plates 50. This position trades the ability to reduce the portion of elongated member 23 outward of bearing surface 33 and thereby the unbalance, with the overhung portion of integral loading surface 32 outward of bearing surface 33 thereby increasing bearing loads on bearing surface 33. Optional use of a hollow section for elongated member 23 also reduces imbalance by directly reducing the mass of the extended portion of the member when compared to a solid section. This exemplary combination, when compared to a constant linear weight option, allows for the desired comfort and feel that the lifter has with grips 21 and 31 while executing the press, eliminates the hazardous interference between members facilitates a full stroke and maintains even deflection characteristic and related lifting experience similar to a traditional static barbell. Similarly, this exemplary combination does not require synchronization and the aforementioned issues of degradation of grip comfort and packaging of the system needed for keeping the grips equidistant from the center of a barbell throughout the stroke.

Along with grip feel and managing imbalance, the range of motion that the lifter's hands see during the press is important, with a goal being to match the efficient trajectory and motion seen when using a dumbbell. This range of motion includes hand translation along axis 100 and hand movement generally upward away from the bench and the lifter's torso, centered generally on axis 200. When considering the upward motion, the execution of a dumbbell press often has the hands come even or lower than the lifter's torso on the bench. To maximize this upward motion with the barbell 10, the portion of the elongated member 23 that approaches the chest when the hands are near the torso should be slim and thereby allow the hands to match the position seen with a dumbbell press. Any synchronization system external to the surface of the barbell that the grips slide on would increase the bulk of the portion of the elongated member 23 that approaches the chest and undesirably limit the upward range of motion the lifter sees leading to a sub-optimized exercise. As for hand translation along axis 100, attempts to maintain a constant linear weight of the barbell 10 would require that a portion of the second member 30 pass under the grip 21 of the first member 20. As mentioned, the stroke, S, of the press for this configuration would be limited as the portion of the second member 30 that passes under the grip would need to carry a supporting element, and whose active stroke would be less than that afforded by member 20 due to the relatively longer length of elongated member 23. Exemplary relative hand translations along axis 100 from about 8 inches to about 36 inches are achievable. Another exemplary range of relative hand translations from about 12 inches to about 30 inches are also achievable.

Along with the range of motion, the weight of the barbell 10 without optional weight plates is an aspect to consider. For replacing traditional barbells, a barbell weight near that of a standard Olympic barbell may be desirable. Also, for some uses, a lower barbell weight may be desired. One exemplary range of weights of the barbell 10 may be from about 75 pounds to about 10 pounds. Another exemplary range of range of barbell weights of the barbell 10 may be from about 40 pounds to about 15 pounds. Still another exemplary range of barbell weight of the barbell 10 may be from about 50 pounds to about 40 pounds. Yet another exemplary weight of the barbell 10 may be about 45 pounds. The portion of barbell 10 around the spotter zones 25 and 35 may be used to increase or decrease the barbell weight as desired by optionally increasing or decreasing the diameter and lengths of these portions.

Figure 5:
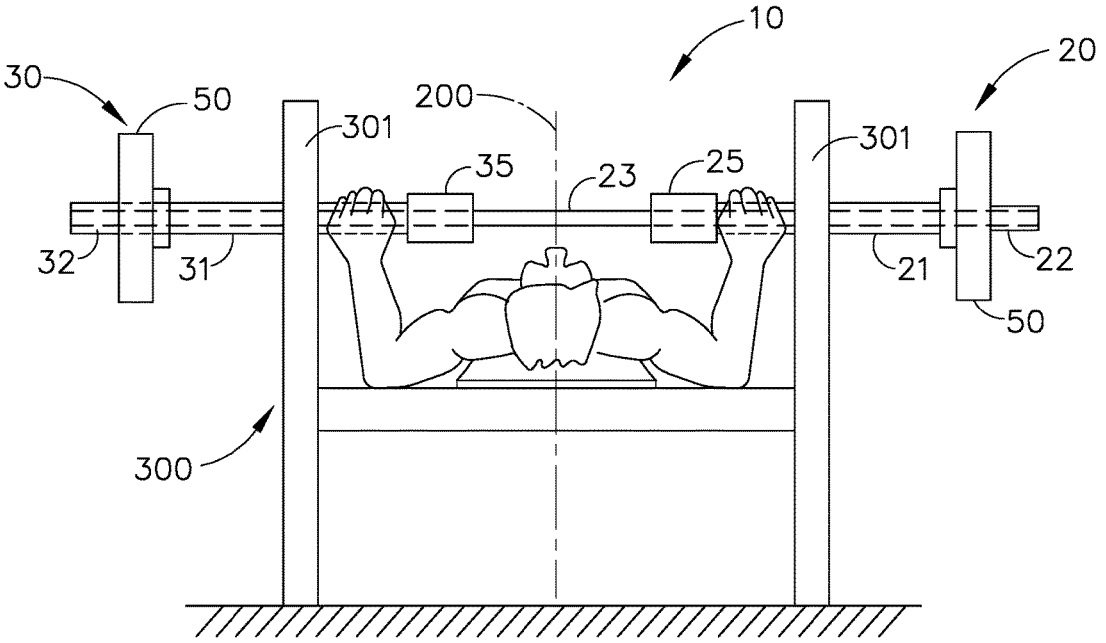
FIGS. 5 and 6 are perspective views of lifter's hand positions that may occur during use of a first exemplary embodiment and includes a description of how weight plates align with bench racks during this use, with 5 describing the full extension in the 'hands out' position and 6 describing the full compression in the 'hands in' position.
Figure 6:
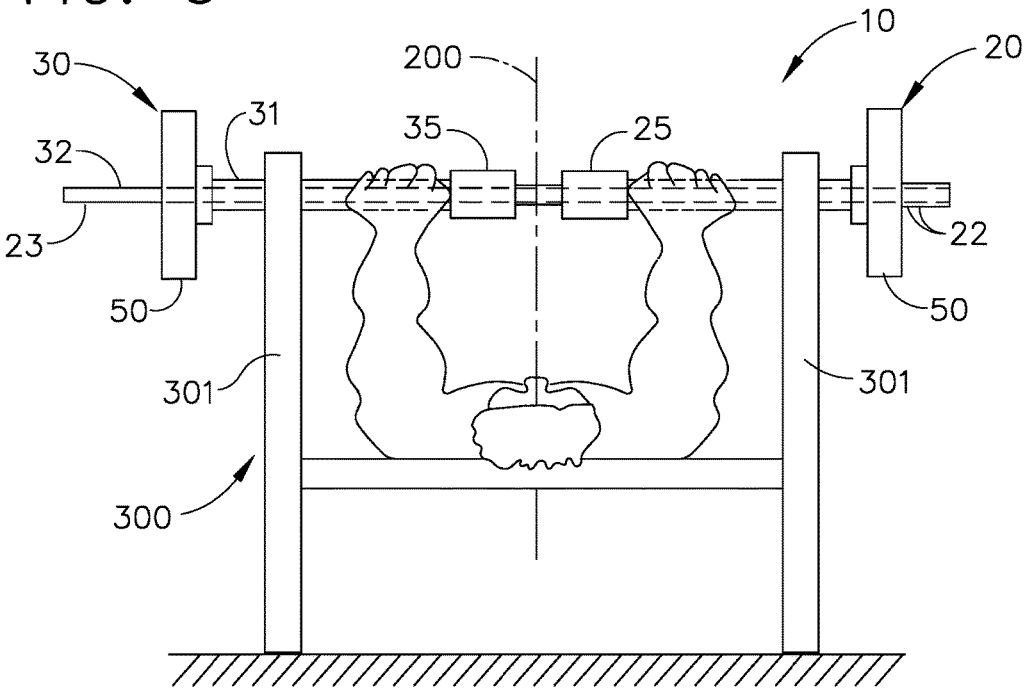

To maximize efficiency, the ability to interchange barbell 10 with traditional barbells is also important. Factors to consider include, for example, the barbell's compatibility with available bench configurations, such as an Olympic style bench, and available plate weight configurations, such as Olympic weights. In FIGS. 5 and 6, the exemplary embodiment from FIGS. 3 and 4 is placed on an Olympic style bench, with the barbell 10 placed on a rack 300. For increasingly heavier lifts, a lifter need only carry plate weights 50, typically ranging from 5 pounds to 45 pounds to the barbell 10 and load them on integral loading surfaces 22 and 32, this in contrast to a lifter carrying and positioning heavy dumbbells, often individually weighing more than 150 pounds. A feature of this exemplary embodiment is that the integral loading surfaces 22 and 32 remain outside rack stands 301 throughout the motion when the lifter maintains axis 200 roughly over the center of the lifter and bench. This is achieved by spacing apart loading surfaces 22 and 32 along axis 100, referred to as distance E in FIG. 3, from greater than about 40 inches. This allows the optimal full motion while providing clearance to the rack stands 301, minimizing clashing of the optionally applied plate weights 50 with rack stands 301 during the motion.

Again referring to FIG. 5 and FIG. 6, as grips 21 and 31 are urged together moving from the 'hands-out' to the 'hands-in' positions, a potential pinch-point is developed near the instantaneous center of motion between hands on axis 200. This area would be a location where a person spotting the lifter, or spotter, could potentially place a hand and be pinched by one or both of members 20 and 30. This exemplary embodiment has spotter zones 25 and 35 on members 20 and 30 respectively that serve as a place where a spotter may safely place their hands to either assist the lifter to rack the barbell 10 on the rack stands 301 or to add additional resistance against the upward motion of the hands or against translational motion of the hands along axis 100 during the exercise or optionally assist the lifter in the same motions. This spotter assistance is a feature that many free weight lifters have become accustomed to when using a traditional static barbell. Another efficiency feature of the exemplary embodiment shown in FIGS. 3 and 4 is a translation limiter 26 which is attached or can be integrated into elongated member 23. Translation limiter 26 provides intentional interference with bearings 46 and thereby controls the range of motion along axis 100 at both the 'hands-out' and 'hands-in' positions. This feature prevents second member 30 from sliding off the elongated bar 23 during exercise or transport and helps to prevent pinching near the center of barbell 10 when the lifter's hands are at or near the 'hands-in' position.

Along with interchangeability and exercise efficiency, portability is another benefit free weight lifters look for when selecting exercise equipment. Exemplary embodiments of barbell 10 may include a lock out system 36, bearings 46, rod wiper 38, spacer 37, and snap rings 39. The lock out system 36, when engaged, temporarily locks second member 30 to elongated member 23. When locked, barbell 10 can be utilized as a static bar for presses or other barbell exercises not requiring translation at the grips or can be moved safely to another bench or location. An exemplary lock out system 36 may be a rotating captured spring-pin arrangement that has at least two positions, unlocked and locked. The lock out system 36 has an outer sleeve 40, pins 41, springs 42, and an inner sleeve 43. In the unlocked position, pins 41 may be urged outward by springs 42 to protrude through holes in outer sleeve 40, allowing clearance between the pin an elongated member 23. To engage the lock out system 36, a lifter need only press pins 41 inward while rotating outer sleeve 40, thereby introducing interference between the inner diameter of the rotated outer sleeve 40 and the head of pin 41, forcing the opposite end of the pin to contact elongated member 23. This applied contact force holds member 30 in position with elongated member 23. Inner sleeve 43 retains pin 41 and provides a reaction surface for spring 42. In this exemplary embodiment two positions, pins 41 and related springs 42 are shown, however one or more positions and pin-spring combinations could be used. Optionally, a pin 44-spring 45 combination could be used for preventing the outer sleeve 40 from rotating or sliding along axis 100 on second member 30 either with or without having pin 44 contact elongated member 23. This pin 44 would also provide an additional visual indicator of the unlocked or locked position of lock out system 36. Another exemplary embodiment of the lock out system 36 arrangements may include a collet or a Jacob's chuck. Yet other lock out system 36 arrangements could include, for example, a band clamp around elongated member 23, a pin that passes through second member 30 and elongated member 23, and a recess or protruding surface along elongated member 23 that would engage a spring loaded pin protruding through second member 30, a spring loaded detent ball, or other suitable mechanical locking arrangement for two or more sliding members in close proximity. Also optional use of rod wipers 38, located adjacent to bearing 46, which may act to keep the elongated member 23 clean for smooth operation of bearing surface 46 during the exercise and limit any stick or hesitation due to build-up of debris on elongated member 23. Other means of preventing build-up of debris on a sliding member could be used, including, for example, a brush seal or a tight tolerance bushing. Spacer 37 and snap rings 39 may be combined to position and retain the bearings 46, rod wipers 38, and lock out system 36 inside second member 30.

Moving now to the description of hand grip 31 and bearing 46 in FIGS. 3 and 4. As mentioned, the diameter or perimeter of hand grip 31 is important to hand comfort and feel during use of barbell 10. As such, because elongated member 23 passes inside of hand grip 31 during use, clearance between the inner diameter of hand grip 31 and elongated member 23 is also important. With the ranges of hand grip diameters and perimeters previously described, the radial space for both this clearance and a bearing 46 is limited. In this embodiment, bearings 46 have an outer diameter that is nearly the same as the diameter of hand grip 31. By allowing the outer diameter of the bearing to be close to or larger than the hand grip 31 diameter, the comfortable grip can be achieved while opening radial space to accommodate bearings 46 in second member 30.

To increase exercise efficiency, another embodiment of barbell 10 may include the addition of springs to provide intentional resistance to the axial translation. This resistance may be provided by placement of a coil spring 70 that wraps around elongated member 23 between first member 20 and second member 30. During the exercise, coil spring 70, would be compressed, resisting the hand translation, providing this intentional resistance. Pneumatic shocks, hydraulic cylinders, a rub button, or another equivalent method of providing intentional resistance to the relative axial translation of members 20 and 30 could also be used.

The foregoing has described exemplary embodiments of barbell 10 used for performing a free weight bench press exercise to match the more optimal motion of a free weight dumbbell press. These embodiments could be used for standing or seated row or curl, or any other free-weight based exercise where relative motion between hands would be beneficial. To provide a varied hand feel for a curl or row, alternative hand grips 21 and 31 can be incorporated. These alternative hand grips 21 and 31 may have a curvilinear shape to provide a comfortable hand position relative to axis 100 that allows use in a curl, row, or other exercises where the line of action of the external load may not be aligned with the arms of the lifter. The hand grips 21 and 31 may optionally rotate around axis 100. Other shapes of hand grips 31 and 21 could include an offset static or rotating ring, a flexible rope or wire, or any hand grip 21 and 31 shape that positions hands other than in alignment with axis 100.

An exemplary assembly of an exemplary embodiment of the barbell 10 can be performed as follows; first a translation limiter 26 is affixed to elongated member 23. Next, the bearing 46 is installed into the inner end of member 30. Next a rod wiper 38 and spacer 37 are loaded into the portion of the second member 30 that holds bearing 46, followed by a snap ring 39 to retain bearing 46. Next, elongated member 23 is slid into second member 30 from what will become the outside of second member 30 toward the inside. Next, a similar bearing 46 is installed into the outer end of second member 30, followed by a rod wiper 38 and lastly by a snap ring 39 to retain the assembly. Next, elongated member 23 is affixed to first member 20. A spacer portion that is a part of member 20 bottoms out on the outermost end of elongated member 23, and is then captured onto the end of elongated member 23 by a fastener. Next, a counterweight 24 is slid into the end of member 20, followed by a snap ring 39. The snap ring 39 serves to anti-rotate the fastener and hold in place counterweight 24.

Along with free weight exercise another class of popular exercise is cable-resistance exercise. When performing cable-resistance exercises using the hands, a lifter grasps a bar that is also attached to a cable. This cable runs to and through a pulley system to a stack of weights remote to the lifter. The lifter then pulls or curls the bar against the resistance of the cable provided by the remote stack of weights through the pulley system. For these exercises, the external load seen by the lifter stays along the cable throughout the motion. Benefits provided by the translation of barbell 10 in free weight exercises, such as optimized exercise, increased safety and convenience, can also be realized in cable-resistance exercises when using barbell 10.

Figure 7:
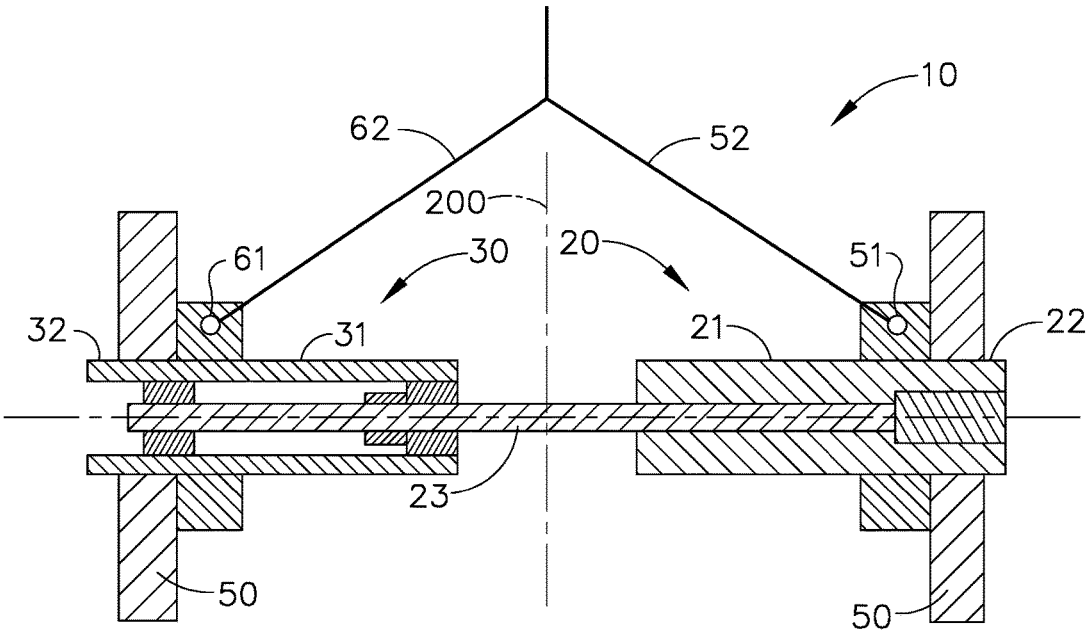
FIGS. 7 and 8 are a perspective views of a another exemplary embodiment for use in a cable resistance exercise, with 7 describing the full extension in the 'hands out' position and 8 describing the full compression in the 'hands in' position.
Figure 8:
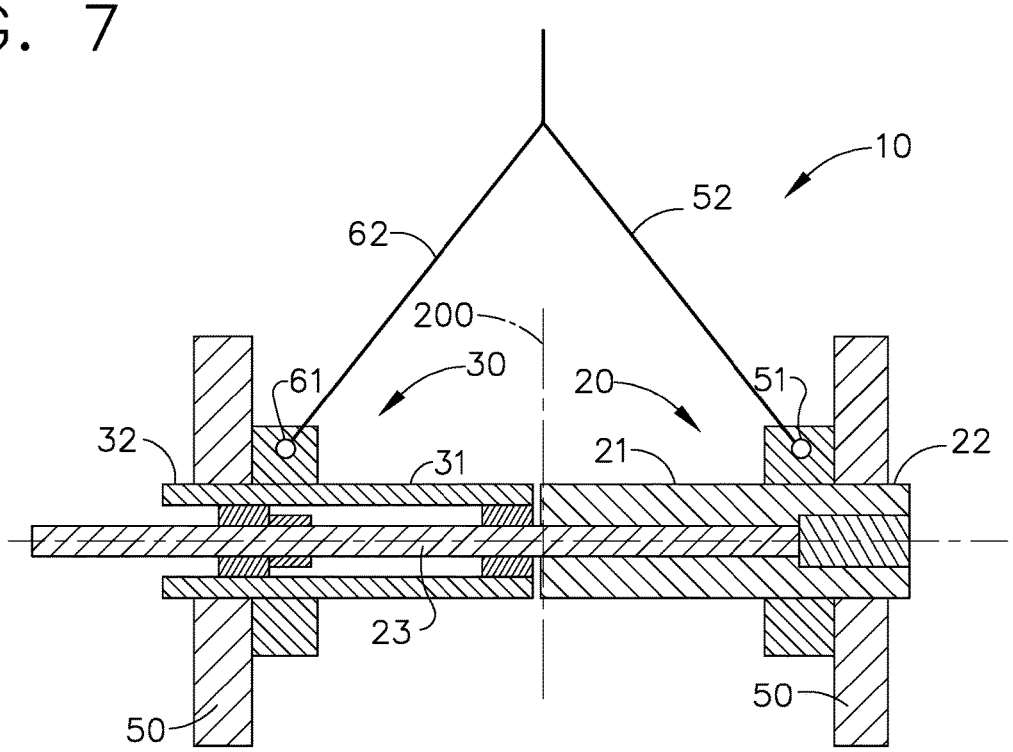

Existing bars for cable resistance exercises are limited to external loading acting along the axis of a cable throughout the motion, reducing the efficiency of a workout where motion of the bar during cable exercise does not utilize an optimal set of muscles. FIGS. 7 and 8 are cross sectional views of a barbell according to another exemplary embodiment being used for a cable resistance row, with 9*a* describing the barbell 10 in full extension in the 'hands out' position and 9*b* describing the barbell 10 in full compression or in the 'hands in' position. Also shown in this exemplary embodiment of barbell 10 are integral loading surfaces 22 and 32 along with cables 52 and 62 that are attached to first member 20 and second member 30 via attachment features 51 and 61. Integral loading surfaces 22 and 32 allow the addition of free weights 50, which in turn provides an external load in the direction of gravity, when combined with the external load in the cable, increases the efficiency of a workout over an existing cable resistance bar by utilizing additional muscles over standard cable bar row. This benefit for a row or other cable resistance exercise could be seen with the barbell 10 in an unlocked or locked position. Attachment features 51 and 61 could be a captured pin, a hook, eyelet or other suitable latching feature.

Additionally, as the lifter's hands translate during the exercise, the constant external resistance through cables 52 and 62 acts to center the motion along axis 200 throughout the translation. Cables 52 and 62 in this exemplary embodiment are substantially equal length, and could be wire cable, chain, rope, or any other suitable tension carrying member. Optional compartments 63 may be present in barbell 10 where cable 62 can be stored within barbell 10 to prevent misplaced or mismatched cables. Compartment 63 could be a groove or open recess, an internal space, or the like. For storage, the cable 62 can be wrapped around second member 30 and latched back on attachment features 61. To stow and latch cable 52, a matching compartment can be included in first member 20, similarly using attachment feature 51 to latch cable 52.

Figure 9:
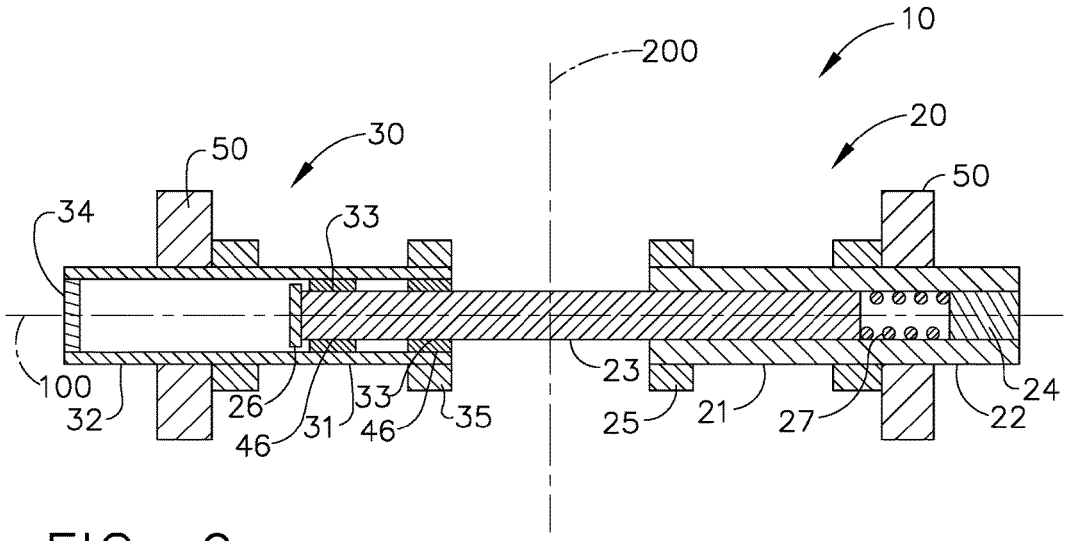
FIGS. 9 and 10 are cutaway views of another exemplary embodiment, with 9 describing the full extension in the 'hands out' position and 10 describing the full compression or in the 'hands in' position including an alternative exemplary translation limiter.
Figure 10:
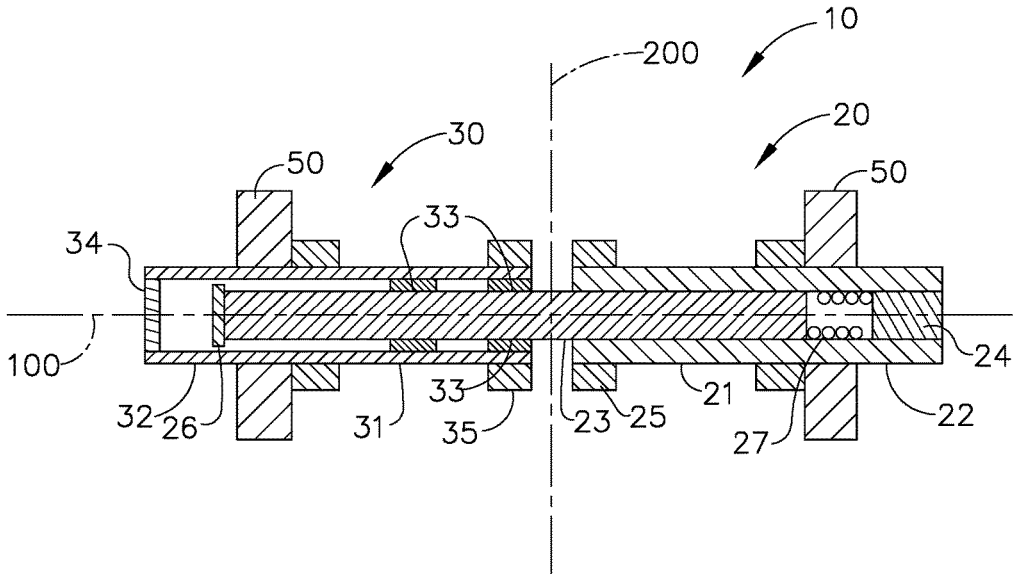

An alternate exemplary embodiment of barbell 10 is shown in FIGS. 9 and 10. In this exemplary embodiment, in a similar manner as described in FIG. 3 and FIG. 4, FIG. 9 describes first member 20 and second member 30 along axis 100 in the 'hands out' position and FIG. 10 in the 'hands in' position. Included on elongated member 23 is an alternate embodiment of translation limiter 26, which may be in the form of a disc, spacer, plate, or the like, that is coupled to elongated member 23 on or near the end of elongated member 23 that is proximal to second member 30. Such a translation limiter 26 may be metal or plastic and may be bolted, welded, adhered, or otherwise coupled to elongated member 23, and may be larger in diameter than bearing surface 33, such that when the second member is translated into the 'hands out' position the stroke is limited when the translation limiter 26 contacts second member 30. Exemplary non-limiting locations where translation limiter 26 may contact second member 30 is at around or around bearing 46, at portions of second member 30 that hold or locate bearing 46, and the like. Also included in this alternate exemplary embodiment of barbell 10 is an end cap 34 coupled to the distal end of second member 30. End cap 34 may be metal or plastic and may be in the form of a disc, spacer, plate, or the like. As the lifter compresses barbell 10, translation limiter 26 on the end of elongated member 23 contacts end cap 34, thereby limiting the stroke at the 'hands in' position. End cap 34 may alternatively be integral to second member 30.

As shown in FIGS. 9 and 10, first member 20 may include optional damper 27. Damper 27 may be placed inside first member 20 and generally between elongated member 23 and the distal end of member 20 (away from the instantaneous center of motion between hands). By including damper 27, any noise that may be generated during use of barbell 10 may be reduced. For example, damper 27 may absorb impact energy as translation limiter 26 contacts second member 30. Non-limiting, exemplary dampers 27 may include springs, foam pad, rubber pad, and the like. Dampers 27 may also be utilized in the second member 30 between elongated member 23 and the distal end of member 30 (away from the instantaneous center of motion between hands) for a substantially similar purpose. Damper 27 may alternatively be coupled to end cap 34 or translation limiter 26.

In the embodiment show in FIGS. 9 and 10, when compared to the exemplary embodiment of barbell 10 of FIGS. 3 and 4, the bearing surface 33 is further inward from the innermost portion of integral loading surface 31. As mentioned above, when describing the exemplary embodiment of barbell 10 of FIGS. 3 and 4, moving the bearing surface 33 inward from the innermost portion of the integral loading surface 31 increases bearing loads. However, with this alternate exemplary embodiment of deflection limiter 26, moving bearing surface 33 inward allows for the end of the elongated member 23 proximal to second member 30 to remain within second member 30 throughout the stroke. For some embodiments of barbell 10, the aspect of containing this end of the elongated member 23 within second member 30 may be desirable, even if the result is an increase in bearing loads.

Figure 11:
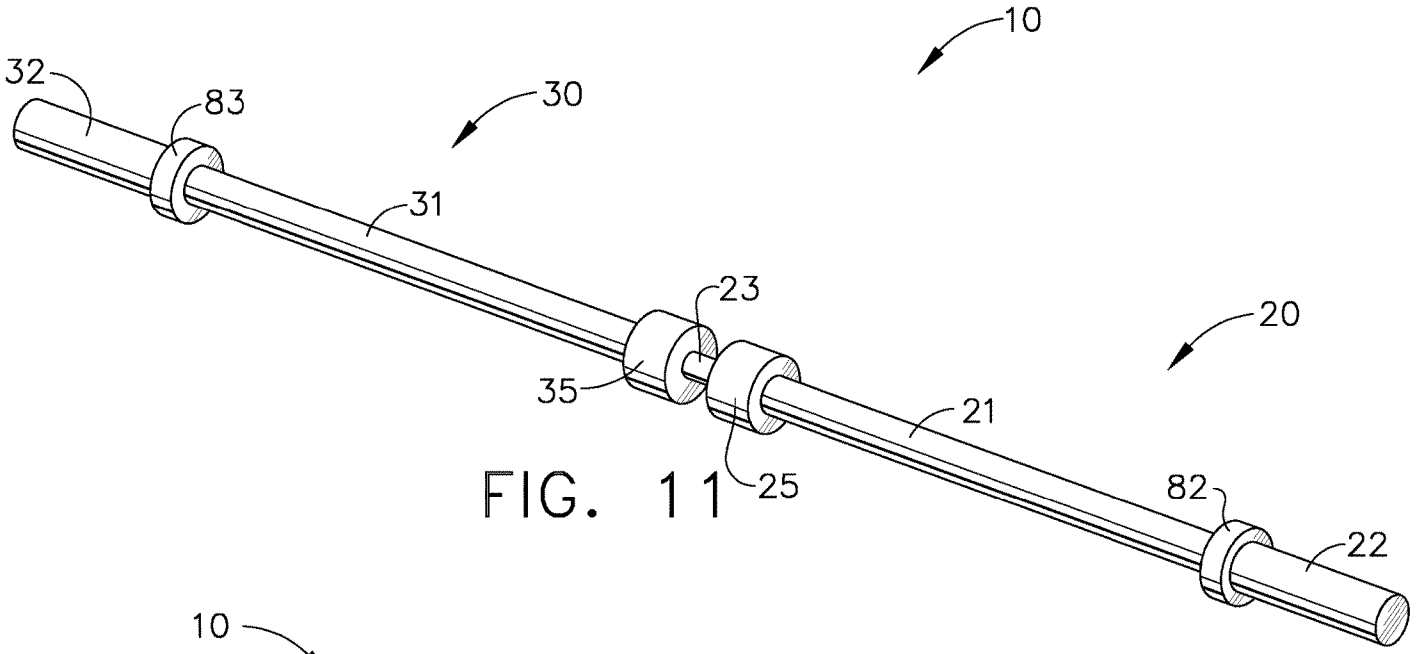
FIG. 11 is an isometric view of yet another exemplary embodiment of the barbell in a 'hands in' or compressed position.
Figure 12:
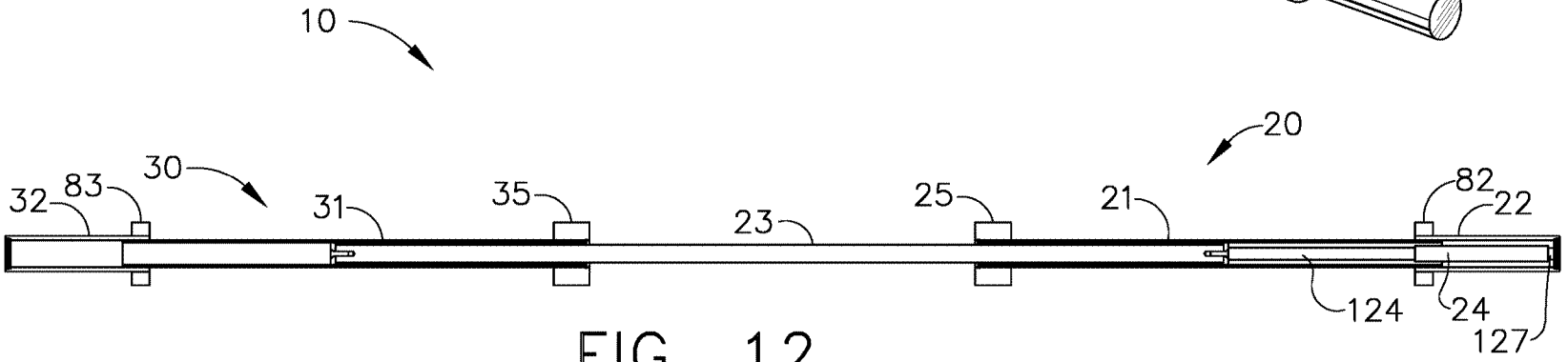
FIG. 12 is a sectional view of the exemplary embodiment of the barbell of FIG. 11.

FIGS. 11, 12, 13A and 13B show yet another exemplary embodiment of exercise lifting bar 10. The isometric view of barbell 10 in FIG. 11, shows first member 20, second member 30 in a compressed position. Also depicted are spotter zones 25 and 35, integral loadings surfaces 22 and 32, and collars 82 and 83. Although the first and second members as shown are constant section, varied section and shape may be utilized. FIG. 12 is a section view of the exemplary embodiment of barbell 10 shown in FIG. 11 in an extended position, exposing more of elongated member 23 and showing details of counterweight 24, counterweight spacer 124, and optional damper 127. As shown near the distal end of first member 20, counterweight spacer 124 and optional damper 127 fill the space inside first member 20 between elongated member 23 and the counterweight 24. The ends of elongated member 23 may be tapped and drilled to accommodate anti-rotation, assembly features, and integration of translation limiter 26 with elongated member 23. As discussed in the prior exemplary embodiments, second member 30 is slidably mounted on elongated member 23, such that when the hand grip 31 and 21 are urged together members 30 and 20 translate. Further aspects of this exemplary embodiment are found in FIGS. 13A and 13B.

Figure 13A:
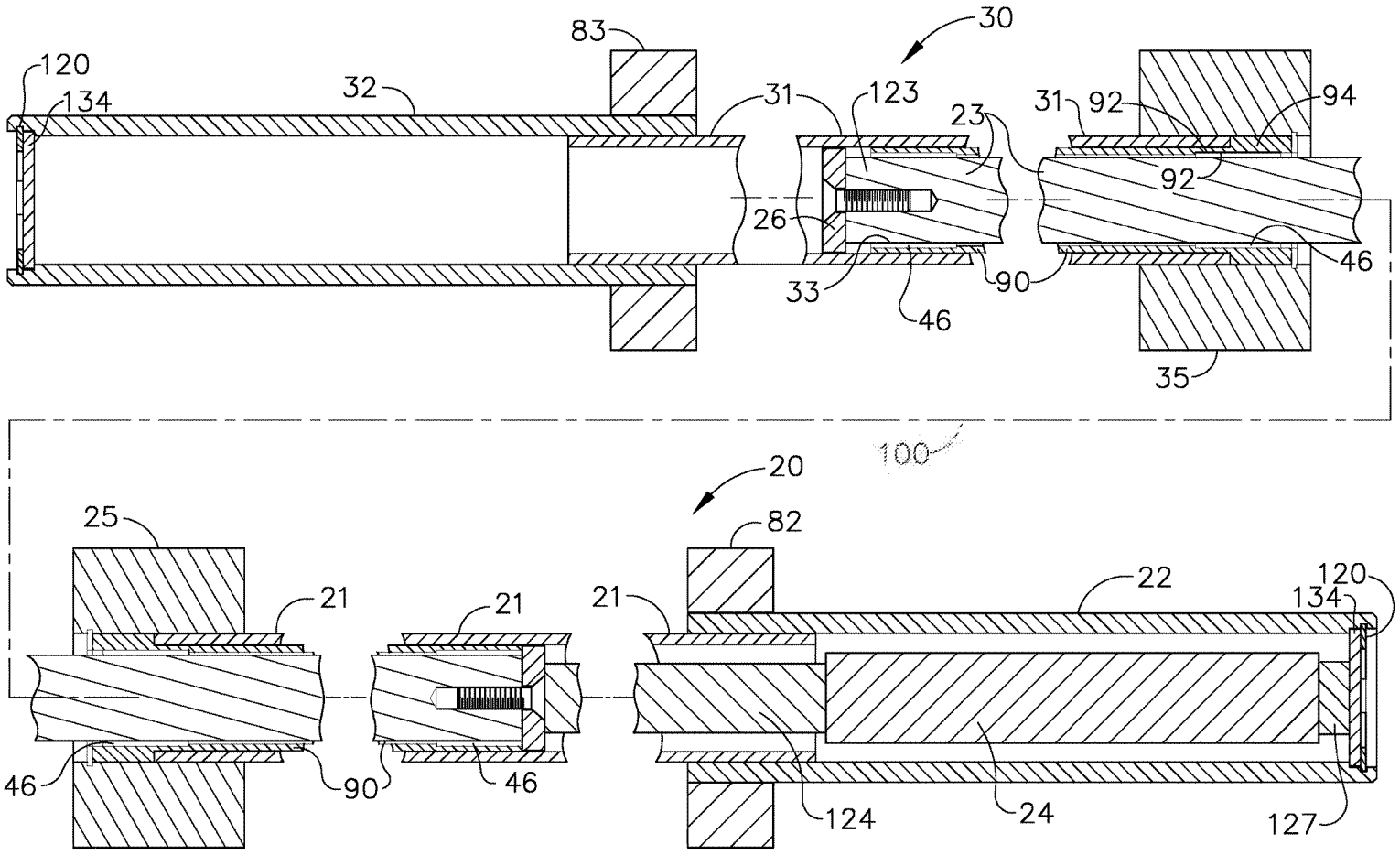
FIGS. 13A and 13B are a exploded sectional views of the exemplary embodiment of the barbell of FIG. 11.

FIG. 13A is an expanded sectional view of both distal ends of the exemplary embodiment of barbell 10 shown in FIGS. 11 and 12. The top portion depicts second member 30, hand grip 31, integral loading surface 32, and end cap 134. Also described in FIG. 13A is cartridge 90. In this exemplary embodiment, cartridge 90 carries two bearings 46. Cartridge 90 has an internal recesses 92 on both ends to accept bearings 46 and an external lip 94 that, when assembled into second member 30, holds cartridge 90 in position during translation. Recess 92 is optional, in part based on the bearing 46 used. Bearings 46 may be loose fit, press fit, or the like inside cartridge 90. As mentioned in prior example embodiments, various bearing forms and materials and the like may be utilized in this assembly. In this example, a snap ring 120 and accompanying groove in second member 30 is used for retention of cartridge 90 and the end plate 130. Cartridge 90 and end cap 134 may be made of similar materials as discussed prior for members 20 and 30.

Now turning to first member 20 and elongated member 23, as shown in the top portion of FIG. 13A, the free end 123 of elongated member 23 resides inside second member 30. In this example embodiment, free end 123 is tapped and drilled to accept screw 110 and translation limiter 26. Although the centerline of the tapped hole is common to elongated member 23, use of a centerline for the hold that is offset from the elongated member centerline may be used for anti-rotation. Additionally, any attachment or integration of translation limiter with elongated limiter may be used, for example, welding, use of adhesives, or the like.

The outer diameter of translation limiter 26 is less than the internal diameter of second member 30, but larger than the outer diameter of bearing 46 and cartridge 90. Therefore, when second member 30, with bearing surface 33 translating on elongated member 23, is moved to the extended position, the stroke or motion is limited when the translation limiter contacts bearing 46 and cartridge 90. Similarly, at the compressed position, the translation limiter contacts end cap 134, thereby limiting the compressed length of barbell 10. As mentioned, this feature is an important advancement, allowing the feel of a full range of motion while safely keeping the two members in engagement.

The lower portion of FIG. 13A shows first member 20, hand grip 21, and integral loading surface 22. In this exemplary embodiment, for commonality of components, first member 20 also utilizes a cartridge 90. Although not sliding in this exemplary embodiment, cartridge 90 carries bearings 46, and is retained by a snap ring at the end of cartridge 90 proximal to spotter zone 25. Also included in first member 20 are spacer 124, counterweight 24, damper 137, as well as end cap 134. As discussed prior in FIGS. 9 and 10, damper 134 may optionally be used in this area to reduce noise and vibration and to absorb impact energy resulting from translation limiter 26 contacting second member 30. Again, non-limiting, exemplary dampers 127 may include springs, foam pad, rubber pad, and the like. Dampers 127 may also be utilized in the second member 30 between elongated member 23 and the distal end of member 30 (away from the instantaneous center of motion between hands) for a substantially similar purpose. Damper 27 may alternatively be coupled to end cap 34 or translation limiter 26.

Figure 13B:
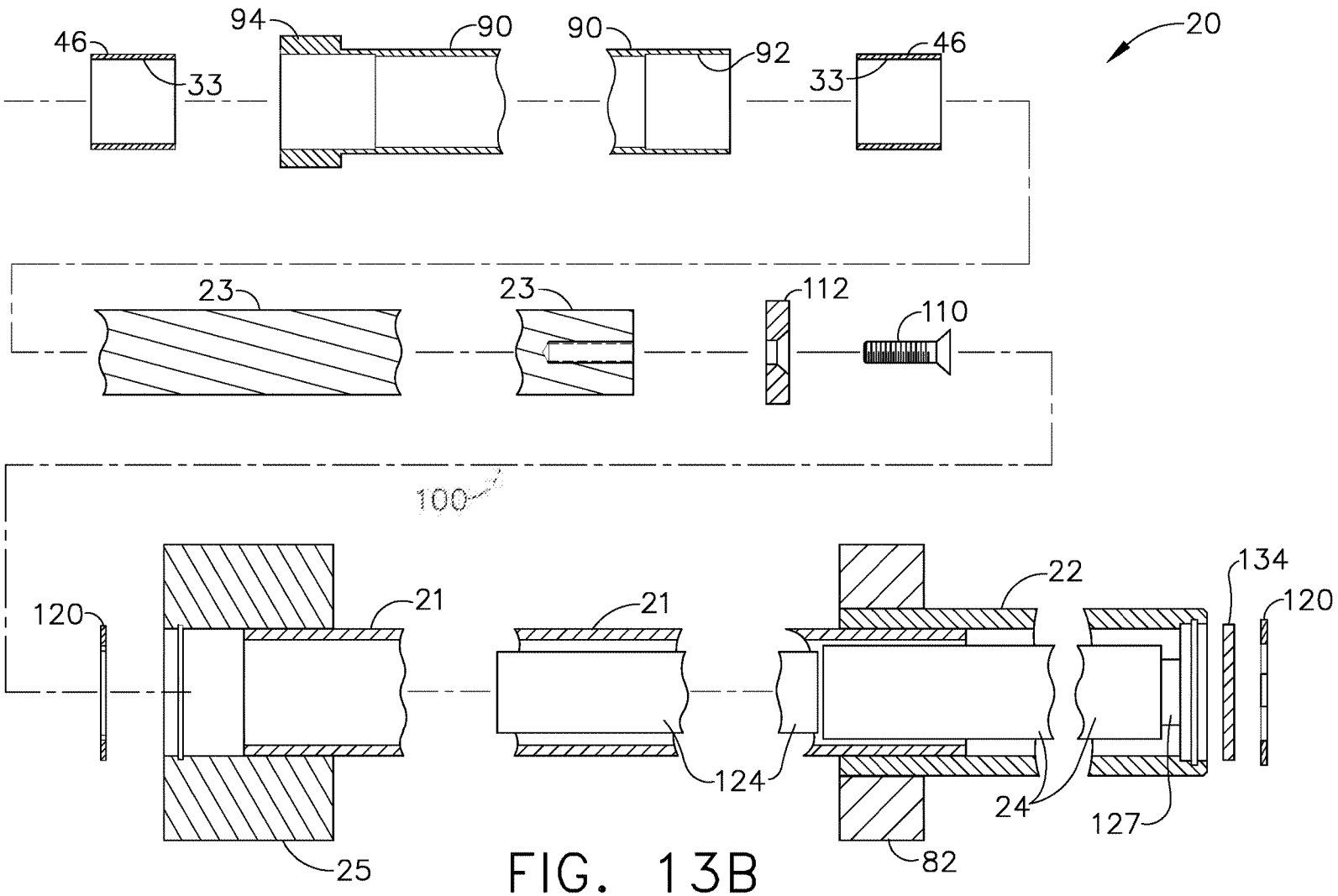

For additional clarity, exploded view FIG. 13B of the exemplary embodiment of barbell 10 shown in FIGS. 11, 12, and 13A is provided. As described above, recesses 92 in cartridge 90 receiving bearings 46. With bearings 46 installed, cartridge 90 may be then slid on elongated member 23. Next cap 112 is coupled to elongated member 23 using a tapped and drilled hole in elongated member 23 via bolt 110. Then the elongated member 23 with cartridge 90 is passed into hand grip 21, and snap ring 120 is used to retain the assembly on the end proximal to spotter zone 25. After this, spacer 124, counterweight 24, and optional damper 127 are inserted into hand grip 21 and integral loading surface 22. Finally, end plate 134 is installed, followed by another snap ring 120 to retain the assembly of first member 20 on the distal end. This sequence is repeated on second member 30 up to installing the snap ring 120 for retaining the assembly on the end proximal to spotter zone 35, with translation limiter 26 replacing cap 112 in the assembly sequence. At any point, optional lubrication, as described prior, may be added to the assembly sequence.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A method for assembling an exercise lifting bar with two members, comprising:

installing a bearing onto one of the two members, the two members each comprising a hand grip and an integral loading surface coupled to the hand grip, wherein the two members are substantially cylindrical, collinear, and translate relative to one another; and a translation limiter, wherein the translation limiter is contained inside the one of the two members with the bearing and is adapted to limit translation via mechanical contact with the one of the two members with the bearing; wherein the integral loading surface and the hand grip are substantially cylindrical and collinear, wherein the integral loading surface is larger in diameter than the hand grip; and wherein a distance between a free end of each of the integral loading surfaces, as measured along a longitudinal centerline of the exercise lifting bar, is configured to vary during use; passing the other of the two members through the one of the two members with the bearing in a direction along the longitudinal centerline of the exercise lifting bar; and coupling the translation limiter to the other of the two members passed through the one of the two members with the bearing.

2. The method of claim 1, further comprising installing the bearing into a cartridge prior to installing the bearing onto the one of the two members.

3. The method of claim 1, further comprising installing a cap at an end of the other of the two members with the translation limiter, wherein the cap is opposite the translation limiter.

4. The method of claim 1, further comprising installing a spacer at an end of the other of the two members with the translation limiter and in the direction along the longitudinal centerline of the exercise lifting bar, wherein the spacer is opposite the translation limiter.

5. The method of claim 3, further comprising installing a spacer adjacent to the cap.

6. The method of claim 4, further comprising installing a counterweight adjacent to the spacer.

7. The method of claim 1, further comprising installing a damper at an end of the other of the two members with the translation limiter.

8. The method of claim 6, further comprising installing a damper adjacent to the counterweight.

9. The method of claim 6, further comprising installing an end cap adjacent to the counterweight.

10. The method of claim 1, further comprising installing a snap ring at an end of the other of the two members with the translation limiter, wherein the snap ring is opposite the translation limiter.

11. The method of claim 1, further comprising installing a damper on the one of the two members with the bearing proximal to the integral loading surface of the one of two members with the bearing.

* * * * *